United States Patent [19]

Carver

[11] 4,397,494

[45] Aug. 9, 1983

[54] FISHING TOOL TO RETRIEVE CABLES FROM WELLS

[75] Inventor: Herman C. Carver, Bakersfield, Calif.

[73] Assignee: Petroworld, Ltd., Spokane, Wash.

[21] Appl. No.: 288,356

[22] Filed: Jul. 30, 1981

Related U.S. Application Data

[63] Continuation-in-part of Ser. No. 193,304, Oct. 2, 1980, Pat. No. 4,353,585.

[51] Int. Cl.[3] ..... E21B 31/12

[52] U.S. Cl. ..... 294/86.1; 294/86.2; 294/86.24

[58] Field of Search ..... 294/61, 66 R, 86.1, 294/86.12–86.14, 86.17–86.21, 86.24–86.32, 93, 95, 97, 104, 110 A, 120, 125–130; 15/104.3 G

[56] References Cited

U.S. PATENT DOCUMENTS

| | | | |
|---|---|---|---|
| 646,422 | 4/1900 | Fisk | 294/86.29 |
| 744,583 | 11/1903 | Meaders | 294/86.24 X |
| 776,425 | 11/1904 | Riggs | 294/86.24 |
| 1,033,531 | 7/1912 | Brown | 294/86.27 |
| 1,445,581 | 2/1923 | Fullop | 294/86.2 |
| 1,610,780 | 12/1926 | Hinderliter | 294/86.27 |
| 2,507,058 | 5/1950 | Stone | 294/86.27 |
| 3,081,123 | 3/1963 | Steed | 294/86.29 |

*Primary Examiner*—Johnny D. Cherry
*Attorney, Agent, or Firm*—Donald D. Mon

[57] ABSTRACT

A fishing tool to snag and to retrieve cables from wells. The tool includes an elongated body which has two ends, a substantial length, and peripheral boundary of lesser lateral dimensions than a well down which the tool is to be sent with the first of its ends pointed down. A snag member is pivotally mounted to the body so that its free end faces toward one of the ends and so that its free end is movable toward and away from the peripheral boundary. Bias means biases the shank to move the free end toward the peripheral boundary, and a detent is interposed between the snag member and the body releasably to hold the snag member with its free end away from the boundary in opposition to the bias force, where it can be released upon contact with an object. The body or the snag member is provided with a snag recess to receive part of the cable.

13 Claims, 14 Drawing Figures

142
140
141
144
143

FISHING TOOL TO RETRIEVE CABLES FROM WELLS

CROSS REFERENCE TO OTHER APPLICATION

This is a continuation-in-part of applicant's co-pending U.S. patent application, Ser. No. 193,304, filed Oct. 2, 1980, now U.S. Pat. No. 4,353,585, entitled "Fishing Tool to Retrieve Cables from Wells".

FIELD OF THE INVENTION

The invention relates to fishing tools for wells.

BACKGROUND OF THE INVENTION

Fishing tools are known to snag and to retrive cables from wells. The classical technique of such an arrangement is to provide a body with some upwardly-directed hook-like member which is moved below a cable, and then moved upward to snag the cable and bring it to the surface. There is a substantial problem involved in the use of this type of fishing tool, which is that if the tool itself goes beyond the bottom end of the oil well pipe or tube, and then the fishing tool is pulled up, the tool can snag on the bottom of the tube and can destroy the tube, and prevent itself from being extricated. This adds to an already bad problem at the bottom of the well.

It is an optional object of this invention to provide a fishing tool which can be lowered to snag a cable, but which is inherently unable to catch on the bottom of the well pipe or tubing.

It is another object of this invention to provide a fishing tool which can be lowered to snag and retrieve a cable, but which, if it catches on the bottom of the well pipe or tubing ("tube" herein), will be triggered so as to retract toward the body of the tool itself where it will no longer constitute an impediment to the withdrawal of the tool from the well.

BRIEF DESCRIPTION OF THE INVENTION

A fishing tool according to this invention comprises an elongated body having two ends, a substantial length, and a peripheral boundary of lesser lateral dimensions than a well down which the tool is to be sent with the first of its ends pointed down. A snag member is rotatably mounted to the body so the free end of the snag member faces toward one of the ends and so that the free end is movable toward and away from the peripheral boundary. Bias means biases the shank to move the free end toward the peripheral boundray. Detent means is interposed between the snag member and the body which is adapted releasably to hold the snag member with the free end away from the boundary in opposition to the bias force exerted by the bias means. Upon release of the detent, the bias means will cause the free end to move toward the boundary in the absence of some other impediment thereto, whereby to trap a cable. The body or the snag member is provided with a snag recess to receive part of the cable.

According to a preferred but optional feature of the invention, the free end is pointed toward the second end, whereby if the detent is struck by the bottom of the well pipe or tubing, the snag member retracts so it ceases to be an impediment to the passage of the tool past the lower end of the tube or pipe.

According to another preferred but optional feature of the invention, the snag member is mounted in a slot in the outer periphery of the body, and behaves as a first class lever.

The above and other features of this invention will be fully understood from the following detailed description and the accompanying drawings, in which:

DETAILED DESCRIPTION OF THE INVENTION

Figure 1:
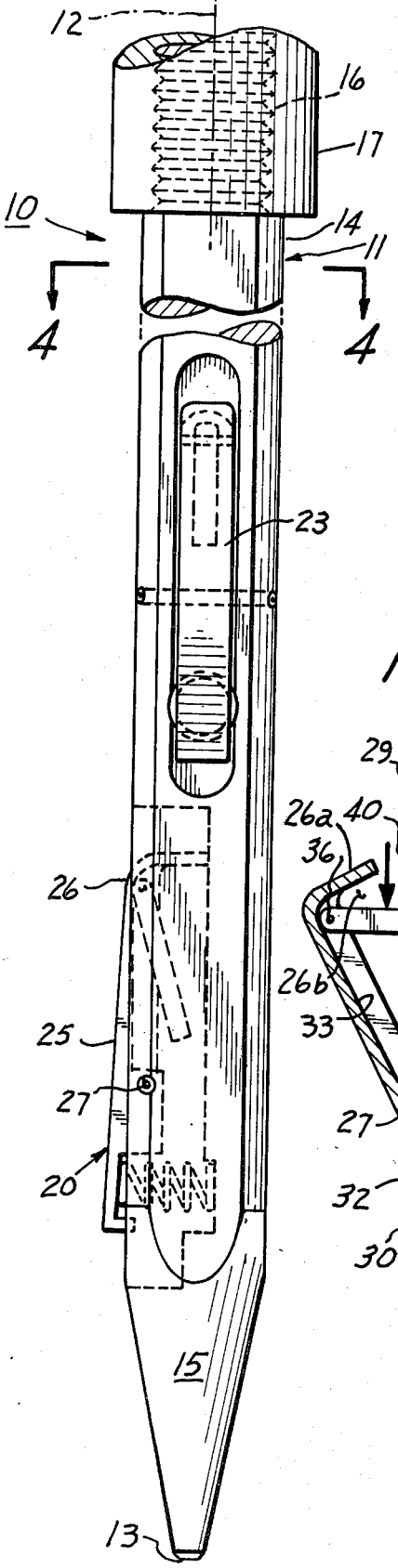
FIG. 1 is a side elevation of one embodiment of the invention.

In FIG. 1 there is shown a fishing tool 10 according to the invention. It includes an elongated body 11 having an axis 12, a first end 13, and a second end 14. The first end includes a taper 15 to assist the first end in passing through material at the bottom of a well. The second end is provided with a thread 16 for attachment to means 17 which enables the tool to be attached either to a pipe or to a cable for being lowered or raised in the well.

A plurality of snag members 20, 21, 22, 23 is shown. These members are angularly spaced apart and preferably are also spaced axially from one another, around and along the axial length of the body. For convenience the body may be made generally square in cross-section. Only snag member 20 will be shown in detail, all of the others being identical to it.

Snag member 20 includes a shank 25 and a free end 26. Free end 26 faces toward the second end of the body (i.e., upwardly). Preferably the shank is formed as a first degree lever around a pivot 27. The pivot is conveniently a transverse pin passed through and fitted in the body. Each shank is mounted in a respective slot 28 which extends axially along the outer boundary 29 of the body. The free end has a flange **26*a* that forms a snag recess 26*b***.

Bias means 30 comprises a coil spring seated in a bore 31 in the bottom of the slot and in a recess 32 in the shank. The shank includes a slot 33 to receive a detent 35 which is pivotally mounted in slot 33 by means of a pivot pin 36. As can best be seen in FIG. 6 the detent can seat inside slot 33. The detent includes a flat end 37 adapted to bear against surface 38 on the body in the body slot 28.

Figure 3:
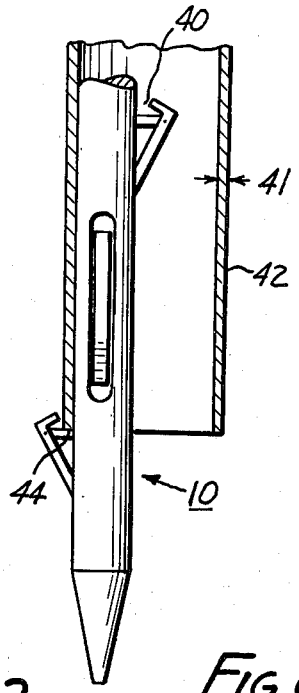
FIG. 3 shows the fishing tool in FIG. 1 in contact with the bottom end of a well tube.
Figure 5:
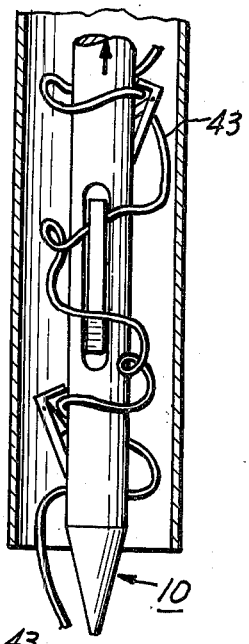
FIG. 5 shows the fishing tool of the invention having snagged a cable in a well.
Figure 2:
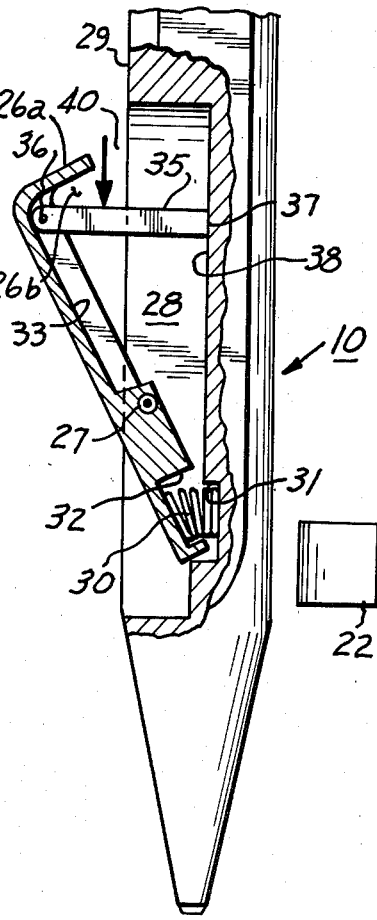
FIG. 2 is an enlarged cutaway portion of FIG. 1.

The dimensions of the snag member will be related to the dimensions of the objects which the fishing tool is to work around. For example, as shown in FIGS. 3 and 5, it is desired for the gap 40 between the flange on the free end and the outer boundary to be somewhat greater than the wall thickness 41 of a well pipe or tube 42 which the snag member might encounter and snap upon. It will also be larger than the diameter of a cable 43 which is intended to be snagged by the fishing tool.

The function of the device of FIGS. 1–6 should be evident from the drawings. Before the fishing tool is sent down the well, the snag members are all set like traps, by placing each detent in the position shown in FIG. 2. The detent will hold the snag member open with the free end pointing upward. The fishing tool will be lowered into the well to below the elevation of the object to be retrieved, and sometimes even below the bottom end of the well tube itself. This latter condition is shown in FIG. 3 from which, the fishing tool is to be brought up. If the detent arrangement of this invention were not provided, the fishing tool could not be withdrawn from the well because it would be engaged to the bottom end 44 of the tubing. However, in this invention, this movement will cause the detent to be moved toward the position shown in FIG. 6. Admittedly, at this time the bottom of the well pipe will be trapped, but the operator will recognize that when he exerts a strong pull on the line which supports the fishing tool and it does not come up, very probably the fishing tool is snagged on the tube. He will then release the line and permit the fishing tool to move down in the pipe so that the free end clears the bottom of the pipe and the snag member will then snap shut. Then the fishing tool can be pulled up out of the well and be reset, because the snag member will no longer protrude beyond the outer boundary in such a way that it can engage the bottom of the tube.

Figure 6:
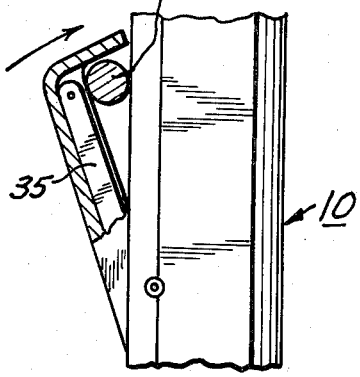
FIG. 6 is an enlarged fragmentary view of a portion of FIG. 5.
Figure 4:
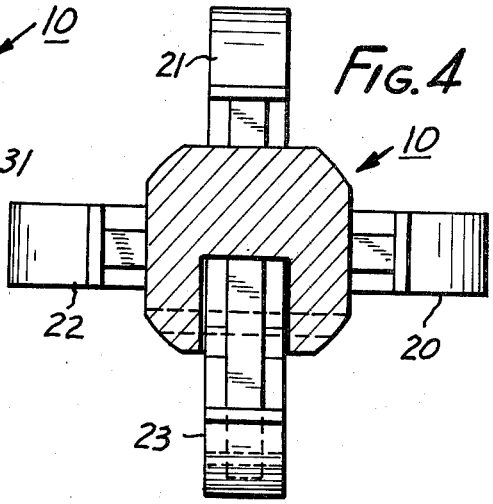
FIG. 4 is a cross-section taken at line 4—4 in FIG. 1.

If, on the other hand, a more desirable situation obtains such as shown in FIG. 5, wherein the fishing tool as first been plunged through the mass of cable and then pulled up, the cable will pass between the free end and the outer boundary, and will contact the detent so as to trip it as shown in FIG. 6. If desired, a spring load can be provided to bias the detent toward the position of FIG. 6. The setting of FIG. 2 can be made in opposition to such a spring load although this usually is unnecessary and sometimes is undesirable. In any event, when the detent is moved to the position shown in FIG. 6 the bias will move the free end toward the boundary. The dimensions have been selected such that the flange on the free end will overhand the cable, and the cable will be trapped in the snag recess and will be brought to the surface together with whatever is on the end of the cable.

It is evident that instead of a pivoted mounting for the shank, the shank can be a springy finger adapted to spring toward the boundary.

Figure 7:
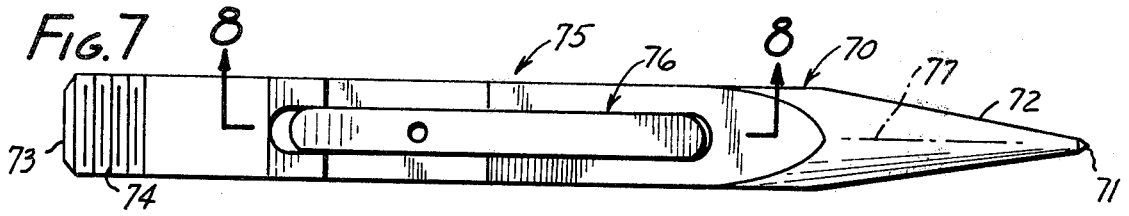
FIG. 7 is a side view of the presently-preferred embodiment of the invention.
Figure 8:
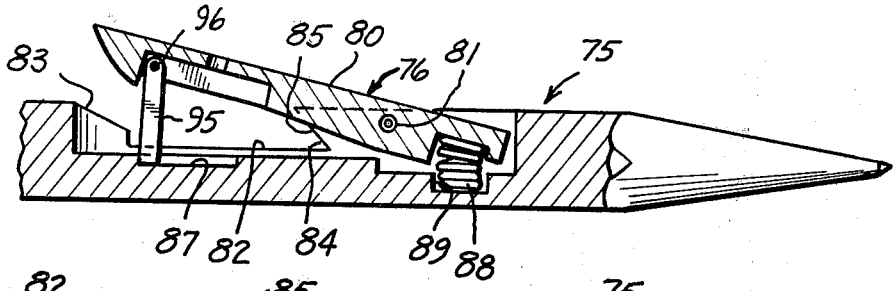
FIG. 8 is a cross-secton taken at line 8—8 in FIG. 7.
Figure 9:
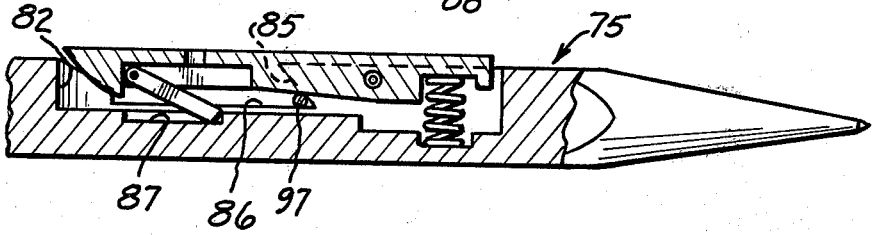
FIG. 9 is a side view taken in the direction of line 8—8 in FIG. 7.

FIGS. 7–9 show the presently preferred embodiment of the invention. Body 70 is elongated, with a periphery that is less than that of the well bore into which it is to be inserted. Conveniently it may have a square cross section formed from a solid bar of material. It has a first end 71 which has a point 72 on it intended for being inserted first down the hole. It has a second end 73 with threads 74 by which it may be attached to a sending cable.

The tool 75 has at least one, and preferably a plurality of, snagging devices 76, spaced axially apart and radially apart from one another around the central axis 77. In this embodiment, a snag member 80 is pivotally mounted to the body in a slot by a pivot pin 81. The body is formed with a recess 82 that has a lead-in ramp 83 and a snag recess 84 formed by a sloping surface 85 facing toward the second end of the tool and sloping outwardly and upwardly toward it. The snag recess has a floor 86 in which there is formed a detent groove 87. A bias spring 88 is seated in a bore 89 and is held in compressive opposition between the body and the snag member so as to bias it counterclockwise in FIG. 8.

A detent member 95 is pivotally mounted by pivot pin 96 near to the free end of the snag member. The free end of the detent member can be seated in detent groove 87 to hold the snag member in its ready position shown in FIG. 8.

The free end of the snag member is pointed toward the second (uphole) end of the tool. In operation, a wire 97 for which the tool is used to fish, may encounter detent member 95 and drive it toward the first end so as to release the snag member so that the bias spring can force it toward the position as shown in FIG. 9. Importantly, the wire is caught in the snag recess 84 where it is backed up by surface 85. In this way this device is an improvement over that of FIGS. 1–6 because the FIGS. 1–6 the wire is primarily supported by the shear strength of the pivot pin which mounts the snag member. In this case the wire is more reliably and strongly held by the body itself. Apart from this feature, the tool functions are the same as the device of FIGS. 1–6.

Figure 10:
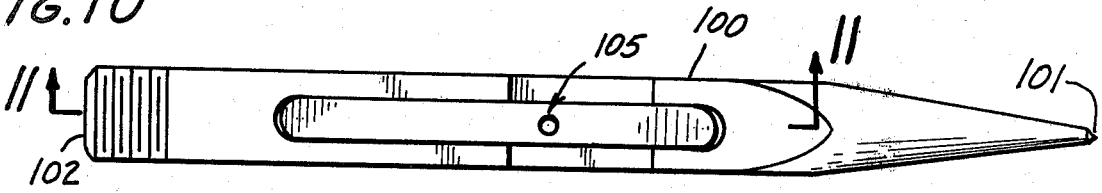
FIG. 10 is a side view of another embodiment of the invention.
Figure 11:
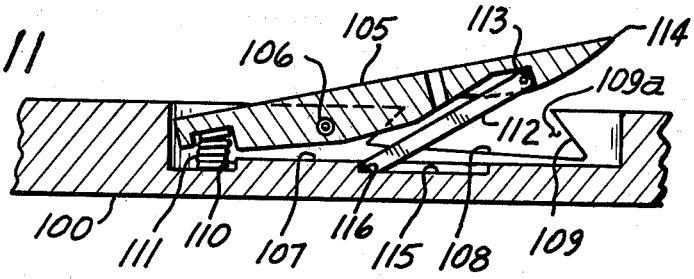
FIG. 11 is a cross-section taken at line 11—11 in FIG. 10.
Figure 12:
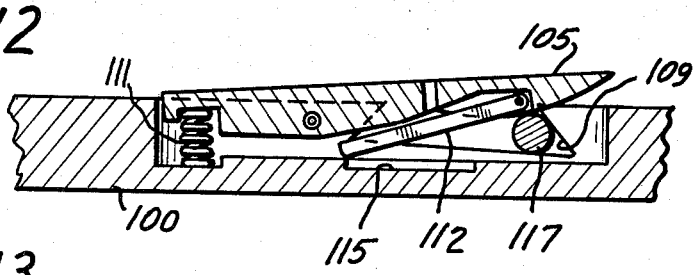
FIG. 12 is a side view taken in the direction of line 11—11 in FIG. 10.

In FIGS. 10–12 there is shown another embodiment of the invention. In this embodiment there is a body 100 which has a first end 101 and a second end 102. In all of FIGS. 1–12 there is an arbitrary number (one or more) of snag members disposed around the periphery of the body, and the body can be made of any arbitrarily selected length. The first end is usually pointed to assist passage of the body through a tangled mass of wire.

Snag member 105 is mounted by means of pivot pin 106 in a slot crossed by a recess 107, which recess extends laterally along the surface of the body. The recess includes a retention cavity 108 with a sloping surface 109. The recess has a bore 110 to support one end of a bias spring 111. Spring 111 bears against the snag member to bias it toward its closed position.

In FIG. 11 the snag member is shown in its ready position. It includes a detent member 112 pivotally mounted by pivot pin 113 to the snag member near the free end 114 of the snag member. The snag member is suitably relieved in order to clear the detent member in some operating positions. A detent groove 115 having a stop shoulder 116 is provided in the bottom of the retention cavity where it can detain the free end of the detent member so as to hold the snag member in the position shown in FIG. 11 until it is released.

In this embodiment, the free end of the snag member points toward the first, i.e. down hole, end and it will not hang up on the bottom of the well pipe or tubing because of this angular relationship. However in order to snag the wire it must catch the wire between the outer surface of the body and the inside surface of the free end of the snag member while moving downwardly rather than upwardly. When it does so, the wire will trip the detent member to push it out of the detent groove, and the bias spring will move the snag member toward the position shown in FIG. 12. Then when the tool is pulled upwardly in the hole i.e. to the left in FIG. 12, wire 117 will be caught against the sloping surface 109 in snap recess 109*a* and will be retained there by the snag member and by the geometry of the structure. Accordingly, there are provided in FIGS. 1–9 devices which catch the wire in an up hole movement and in FIGS. 10–12 in a down hole movement. In all embodiments, the snag member cannot catch on the bottom of the pipe or tubing. In FIGS. 1–10, the pipe or tubing will strike the detent member to release the snag member and the tool can be backed off so that the snag member will close and the tool can then be pulled up. In FIGS. 10–12, the inherent geometry is such that the snag member, in any position, will slide past the bottom of the well or tubing.

A flange-like structure on the free end of the snag member of any embodiment can, when properly proportioned, assist in the retention of the wire.

It should further be noticed that a tool according to this invention can include snag members one or more of which point in one direction i.e. toward the first end, and one or more of which can point in the other direction i.e. toward the second end, in any combination. This provides the advantages of both embodiments.

Figure 13:
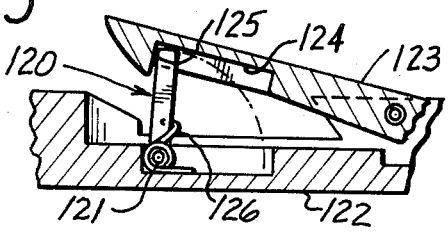
FIG. 13 is a fragmentary view showing another embodiment of detent means.

FIG. 13 shows a detent means 120 which can be substituted for the detent means in any of the embodiments. Instead of being pivotally mounted to the snag member and bearing against the body, detent means 120 is pivotally mounted by pin 121 to body 122 and can bear against snag member 123. A detent groove 124 is formed in the snag member, and the detent member can bear against shoulder 125 to hold the snag member in its ready position.

As an optional feature to make the "cocking" of the snag member more convenient, a clothespin type spring 126 can be coiled around pin 121 to bias the detent member in a counterclockwise direction. The force of the spring is only large enough to raise the detent so it can conveniently be manipulated. A wire pushed against the detent member will readily move the detent member in a clockwise direction (in FIG. 13), and release the snag member so it can be snapped toward the closed position. Thus in all embodiments, the detent member is interposed between the body and the snag member and can be contacted to release the snag member to trap a wire. It is immaterial whether the detent means is mounted to the snag member or to the body.

If spring 126 is not provided, the detent means will simply be grasped and pulled up.

Figure 14:
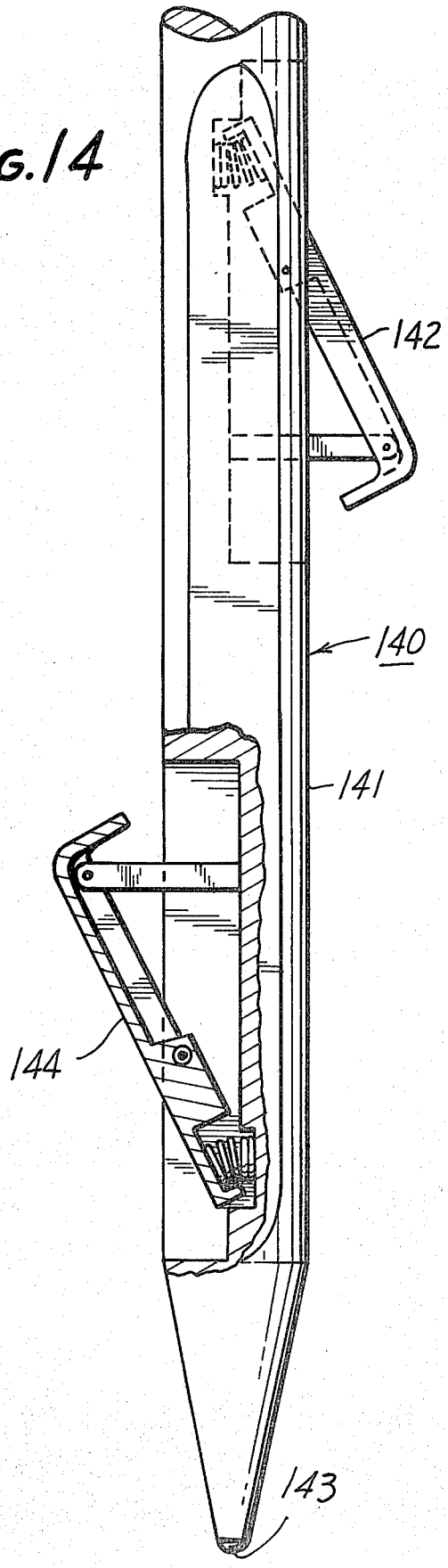
FIG. 14 is a fragmentary view showing yet another embodiment of the invention.

FIG. 14 shows an embodiment in which a fishing tool 140 has an elongated body 141 as in the other embodiments, one or more snag members 142 opening toward its first, downwardly (downwell) pointed, end 143, and one or more snag members 144 opening away from said first end. The snag members are identical to snag member 20, or to any other embodiment of snag member shown herein.

This invention thereby provides an elegantly simple and reliable fishing tool which can snag a cable and bring it to the surface, and which can be released from the bottom of a well pipe or tube should it be snagged upon it. It is simple in construction, rugged and reliable in operation.

This invention is not to be limited by the embodiments shown in the drawings and described in the description which are given by way of example and not of limitation, but only in accordance with the scope of the appended claims.

I claim:

1. A fishing tool to snag and retrieve cables from wells, comprising: an elongated body having a first and a second end, a substantial length, and a peripheral boundary of lesser lateral dimensions than a well down which the tool is to be sent with said first end pointed down; a snag member comprising a shank and a free end on said shank, said shank being mounted to said body so that said free end faces toward one of said body ends and so that said free end is movable toward and away from said peripheral boundary; a snag recess in said body axially aligned with at least part of said shank, said recess being in part defined by a surface facing toward said second end and inclined away from said second end to receive and hold a cable faced into said recess by said snag member while said body is moved toward its second end, bias means biasing said shank to move said free end toward said peripheral boundary; and detent means interposed between said snag member and said body adapted releasably to hold said snag member with its free end outside of said boundary in opposition to the bias force exerted by said bias means, and upon release as the consequence of an object striking said detent means to permit said bias means to move said snag member to cause said free end to move toward said boundary in the absence of some other impediment thereto.

2. A fishing tool according to claim 1 in which said shank is pivotally mounted to said body, and in which said bias means is a spring yieldingly interposed between said shank and said body.

3. A fishing tool according to claim 2 in which said shank is pivotally mounted between its ends so as to form a first class lever, said bias means comprising a compression spring disposed between said shank and said body.

4. A fishing tool according to claim 1 in which an axially-extending slot is formed in said boundary, and said shank is mounted in said slot.

5. A fishing tool according to claim 4 in which said shank is pivotally mounted between its ends so as to form a first class lever, said bias means comprising a compression spring disposed between said shank and said body.

6. A fishing tool according to claim 1 in which said free end of said snag member faces toward said first end.

7. A fishing tool according to claim 6 in which said free end includes an overhanging flange.

8. A fishing tool according to claim 1 in which said detent means is an arm pivotally mounted to said shank, and is in one angular position relative to the shank adapted to abut said body and hold said shank in a position with said free end spaced from the body in opposition to said bias means, said arm being exposed to objects which enter the spacing between said free end and said body to trip said detent means and enable said shank and free end to be moved toward said body to trap said object.

9. A fishing tool according to claim 8 in which said free end of said snag member faces toward said first end.

10. A fishing tool according to claim 9 in which a recess is formed in said periphery of said body toward and away from which said free end is movable, and a wall partially defining said recess against which an object is brought to bear when the body is moved in the direction of its second end.

11. A fishing tool to snag and retrieve cables from wells, comprising: an elongated body having a first and a second end, a substantial length, and a peripheral boundary of lesser lateral dimensions than a well down which the tool is to be sent with said first end pointed down; a snag member comprising a shank and a free end on said shank, said shank being mounted to said body so that said free end faces toward one of said body ends and so that said free end is movable toward and away from said peripheral boundary; bias means biasing said shank to move said free end toward said peripheral boundary; and dentent means interposed between said snag member and said body adapted releasably to hold said snag member with its free end outside of said boundary in opposition to the bias force exerted by said bias means, and upon release as the consequence of an object striking said detent means to permit said bias means to move said snag member to cause said free end to move toward said boundary in the absence of some other impediment thereto, said free end of said snag member facing toward said second end, said detent means comprising an arm pivotally mounted to said shank, which in one angular position relative to the shank is adapted to abut said body and hold said shank in a position with said free end spaced from the body in opposition to said bias means, said arm being exposed to objects which enter the spacing between said free end and said body to trip said detent means and enable said shank and free end to be moved toward said body to trap said object.

12. A fishing tool according to claim 11 in which a recess is formed in said periphery of said body toward and away from which said free end is movable, and a surface partially defining said recess against which an object is brought to bear when the body is moved in the direction of its second end.

13. A fishing tool to snag and retrieve cables from wells, comprising: an elongated body having a first and a second end, a substantial length, and a peripheral boundary of lesser lateral dimensions than a well down which the tool is to be sent with said first end pointed down; a plurality of snag members each comprising a shank and a free end on said shank, said shank being mounted to said body so that said free end faces toward one of said body ends and so that said free ends are movable toward and away from said peripheral boundary; bias means biasing each said shank to move said free end toward said peripheral boundary; and detent means interposed between each said snag member and said body adapted releasably to hold each respective said snag member with its free end outside of said boundary in opposition to the bias force exerted by said respective bias means, and upon release as the consequence of an object striking said detent means to permit said bias means to move said snag member to cause said free end to move toward said boundary in the absence of some other impediment thereto, at least one said snag member pointing toward said first end, and at least one said snag member pointing toward said second end.

* * * * *